US007693433B2

(12) United States Patent
Ohmori et al.

(10) Patent No.: US 7,693,433 B2
(45) Date of Patent: Apr. 6, 2010

(54) IMAGE FORMING APPARATUS AND LAYER THICKNESS CALCULATING METHOD

(75) Inventors: Masao Ohmori, Kanagawa (JP); Chikaho Ikeda, Kanagawa (JP); Hideki Moriya, Kanagawa (JP); Hidehiko Yamaguchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 778 days.

(21) Appl. No.: 11/582,988

(22) Filed: Oct. 19, 2006

(65) Prior Publication Data

US 2007/0166058 A1 Jul. 19, 2007

(30) Foreign Application Priority Data

Jan. 13, 2006 (JP) ..... 2006-005548

(51) Int. Cl.
*G03G 15/00* (2006.01)

(52) U.S. Cl. ..... 399/26; 399/128

(58) Field of Classification Search ..... 399/26, 399/127, 128; 396/439
See application file for complete search history.

(56) References Cited

U.S. PATENT DOCUMENTS 5,485,248 A * 1/1996 Yano et al. ..... 399/73
2006/0165424 A1* 7/2006 Tabb et al. ..... 399/48

FOREIGN PATENT DOCUMENTS

JP A-64-066669 * 3/1989
JP B2-2753406 * 2/1998
JP B2-3064643 * 5/2000
JP B2-3210532 * 7/2001

* cited by examiner

*Primary Examiner*—David M Gray
*Assistant Examiner*—Bamabas T Fekete
(74) *Attorney, Agent, or Firm*—Morgan, Lewis & Bockius LLP

(57) ABSTRACT

An image forming apparatus includes: an image carrier that rotates and carries a toner image by a surface layer disposed on a surface thereof; a charging roll that charges the surface layer while the image carrier completes one or more rotations; a power supply unit that supplies a current to the charging roll; a detector that samples and detects the current that the power supply unit outputs; a leak current detector that detects a leak current included in the current that the detector has detected; a layer thickness calculating unit that calculates a numerical value relating to the thickness of the surface layer on the basis of the current that the detector has detected; and a current leak state determining unit that determines a current leak state on the basis of the current that the detector has detected and the leak current that the leak current detector has detected.

15 Claims, 5 Drawing Sheets

CHARGING CURRENT CHARACTERISTICS

IMAGE FORMING APPARATUS AND LAYER THICKNESS CALCULATING METHOD

BACKGROUND (1) Technical Field

The present invention relates to an image forming apparatus including an image carrier that is charged and carries a toner image and to a layer thickness calculating method that calculates a numerical value relating to the thickness of a photoconductor layer disposed on an image carrier.

(2) Related Art

In image forming apparatus including a photoconductor that is charged and carries a toner image, the photoconductor layer formed on the surface of the photoconductor sustains wear as a result of a charging roll, a development roll, and a cleaning blade contacting the photoconductor layer.

In this type of image forming apparatus, there has been the problem that when the photoconductor layer of the photoconductor sustains wear, the image quality of the output image drops.

SUMMARY

According to an aspect of the present invention, there is provided an image forming apparatus including: an image carrier that rotates and carries a toner image by a surface layer disposed on a surface thereof; a charging roll that charges the surface layer of the image carrier while the image carrier completes one or more rotations; a power supply unit that supplies a current to the charging roll; a detector that detects the current that the power supply unit outputs; a leak current detector that detects a leak current included in the current that the detector has detected; a layer thickness calculating unit that calculates a numerical value relating to the thickness of the surface layer of the image carrier on the basis of the current that the detector has detected; and a current leak state determining unit that determines a current leak state on the basis of the current that the detector has detected and the leak current that the leak current detector has detected.

BRIEF DESCRIPTION OF THE DRAWINGS

An exemplary embodiment of the present invention will be described in detail based on the following figures, wherein.

DETAILED DESCRIPTION

Next, an exemplary embodiment of the present invention will be described on the basis of the drawings.

Figure 1:
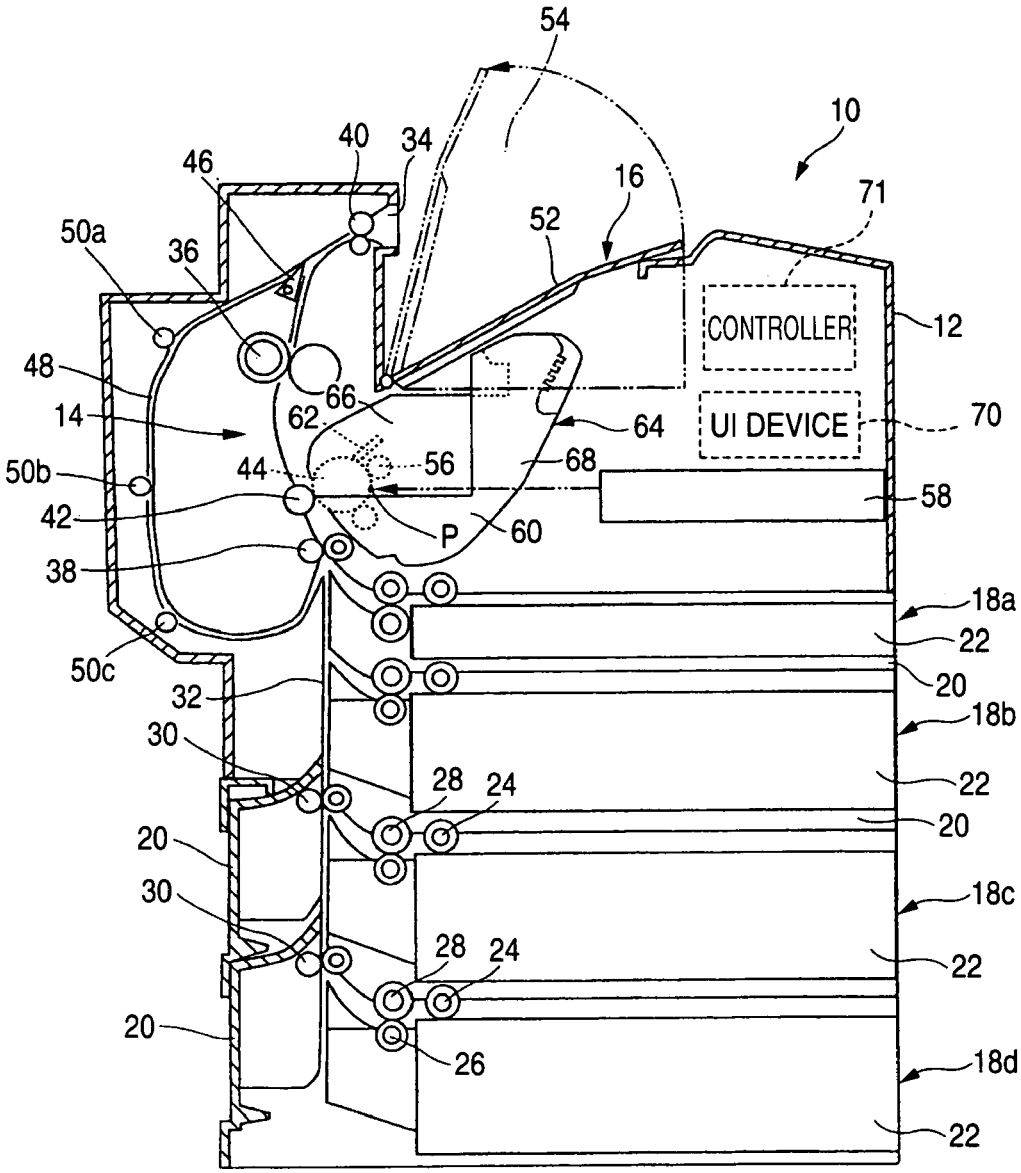
FIG. 1 is a side view showing an image forming apparatus pertaining to the exemplary embodiment of the invention.

In FIG. 1, there is shown an image forming apparatus 10 pertaining to the exemplary embodiment of the present invention. The image forming apparatus 10 includes an image forming apparatus body 12. An image forming section 14 is installed inside the image forming apparatus body 12. A later-described discharge unit 16 is disposed in the upper portion of the image forming apparatus body 12, and two paper supply units 18*a* and 18*b*, for example, are disposed in the lower portion of the image forming apparatus body 12. Moreover, two paper supply units 18*c* and 18*d* that may be loaded and unloaded as options are disposed in the lower portion of the image forming apparatus body 12.

Each of the paper supply units 18*a* to 18*d* includes a paper supply unit body 20 and a paper supply cassette 22 in which paper is stored. The paper supply cassettes 22 are loaded such that they can freely slide with respect to the paper supply unit bodies 20, and are pulled out in the front direction (right direction in FIG. 1). Further, a paper supply roll 24 is disposed in the upper portion of the vicinity of the deep end of each of the paper supply cassettes 22, and a retard roll 26 and a nudger roll 28 are disposed in front of each of the paper supply rolls 24. Moreover, feed rolls 30 that form pairs are disposed in the optional paper supply units 18*c* and 18*d*.

A transportation path 32 is a paper path from the feed roll 30 of the lowermost paper supply unit 18*d* to a discharge port 34. The transportation path 32 includes a portion that is formed substantially vertically in the vicinity of the rear side (left side in FIG. 1) of the image forming apparatus body 12 from the feed roll 30 of the lowermost paper supply unit 18*d* to a later-described fixing device 36. A later-described transfer device 42 and an image carrier 44 are disposed upstream of the fixing device 36 in the transportation path 32, and a registration roll 38 is disposed upstream of the transfer device 42 and the image carrier 44. A discharging roll 40 is disposed in the vicinity of the discharge port 34 in the transportation path 32.

Consequently, a recording medium fed by the feed roll 24 from the paper supply cassettes 22 of the paper supply units 18*a* to 18*d* is sorted by the retard rolls 26 and the nudger rolls 28, guided to the transportation path 32, temporarily stopped by the registration roll 38, and is passed at a timing between the later-described transfer device 42 and the image carrier 44, where a toner image is transferred to the recording medium. The transferred toner image is fixed to the recording medium by the fixing device 36, and the recording medium is discharged by the discharging roll 40 through the discharge port 34 and into the discharge unit 16.

In the case of two-sided printing, the recording medium is returned to an inversion path. That is, the transportation path 32 before the discharge roll 40 is forked, a switching pawl 46 is disposed in the forked portion, and an inversion path 48 that returns from the forked portion to the registration roll 38 is formed. Conveyance rolls 50*a* to 50*c* are disposed in the inversion path 48. In the case of two-sided printing, the switching pawl 46 is switched to the side opening the inversion path 48, the discharging roll 40 is reversely rotated at the point in time when the trailing end of the recording medium reaches the discharging roll 40, the recording medium is guided to the inversion path 48, is passed by the registration roll 38, the transfer device 42, the image carrier 44, and the fixing device 36, and is discharged through the discharge port 34 and into the discharge unit 16.

The discharge unit 16 includes an inclined portion 52 that is freely rotatable with respect to the image forming apparatus body 12. The inclined portion 52 is inclined such that the portion near the discharge port 34 is low and the inclined portion 52 gradually becomes higher in the front direction (right direction in FIG. 1). The portion of the inclined portion 52 near the discharge port 34 is the lower end of the inclined portion 52, and the portion of the inclined portion 52 that is higher is the upper end of the inclined portion 52. The inclined portion 52 is supported on the image forming apparatus body 12 such that the inclined portion 52 is freely rotatable about its lower end. As indicated by the two-dot chain line in FIG. 1, an open portion 54 is formed when the inclined portion 52 is rotated upward and opened, so that a later-described process cartridge 64 can be loaded into and unloaded from the image forming apparatus body 12 via the open portion 54.

The image forming section 14 is, for example, an electrophotographic image forming section, and is configured by: the image carrier 44, which includes a photoconductor; the charging roll 56 that uniformly charges the image carrier 44 by pressure contact; an optical writing device 58 that writes a latent image by light onto the image carrier 44 charged by the charging roll 56; a development device 60 that makes visible, by a toner, the latent image on the image carrier 44 formed by the optical writing device 58; the transfer device 42, which includes a transfer roll, for example, and transfers the toner image resulting from the development device 60 onto paper; a cleaning device 62, which includes a blade, for example, and cleans toner remaining on the image carrier 44; and a fixing device 36, which includes a pressure roll and a heat roll, for example, and fixes to the paper the toner image on the paper that has been transferred by the transfer device 42. The optical writing device 58 includes a scanning-type laser exposure device, for example, is disposed in the vicinity of the front side of the image forming apparatus body 12 parallel to the paper supply units 18*a* to 18*d*, and exposes the image carrier 44 to light across the inside of the development device 60. The position where the image carrier 44 is exposed is a latent image writing position P. It will be noted that, although a scanning-type laser exposure device is used as the optical writing device 58 in this exemplary embodiment, an LED or a surface-emitting laser can be used as another exemplary embodiment.

The process cartridge 64 is a cartridge in which the image carrier 44, the charging roll 56, the development device 60, and the cleaning device 62 are integrated. The process cartridge 64 is disposed directly below the inclined portion 52 of the discharge unit 16, and as mentioned previously, is loaded into and unloaded from the image forming apparatus body 12 via the open portion 54 that is formed when the inclined portion 52 is opened.

Further, the process cartridge 64 is divided, such that they can be freely loaded and unloaded, into an image carrier charge unit 66, in which the image carrier 44, the charging roll 56, and the cleaning device 62 are disposed, and a development. device unit 68, in which the development device 60 is disposed.

Further, a user interface (UI) device 70 such as a touch panel is disposed on the outer surface of the image forming apparatus body 12. The UI device 70 receives the input of instructions and the like with respect to the image forming apparatus 10 from a user and displays the processing results and the like of the image forming apparatus 10.

Further, a controller 71 that controls each of the units configuring the image forming apparatus 10 in accordance with the setting and the like of the user inputted via the UI device 70 is disposed inside the image forming apparatus body 12. For example, the controller 71 includes rotational period information of the image carrier 44 and the charging roll 56, counts the number of rotations of the image carrier 44 and the charging roll 56, and controls the periods of time for switching ON and OFF a later-described neutralizing lamp 76 in accordance with the setting of the user inputted via the UI device 70.

Figure 2:
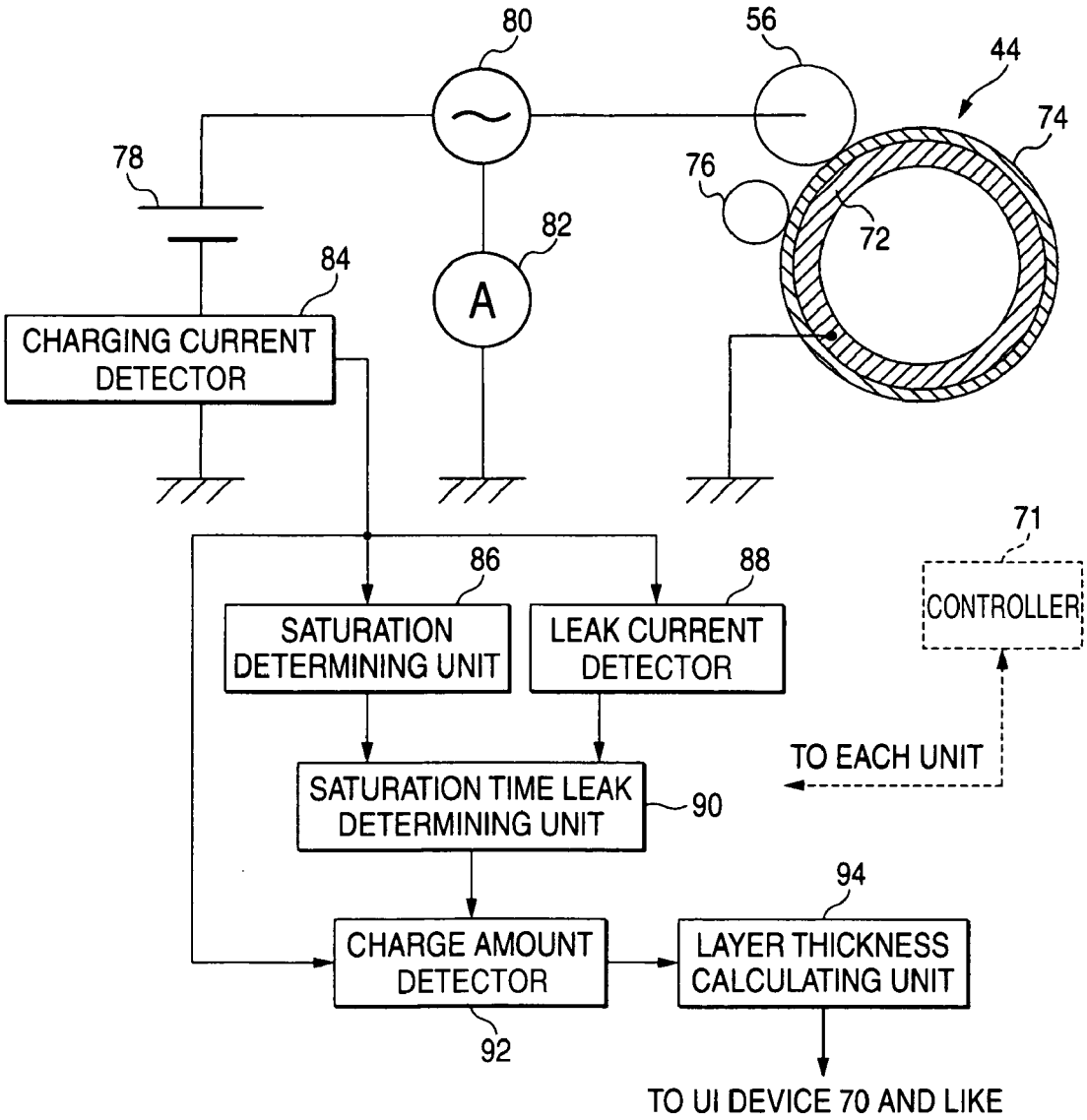
FIG. 2 is a block diagram showing the details of an image carrier, a charging roll, and their vicinity.

In FIG. 2, the details of the image carrier 44, the charging roll 56, and their vicinity are shown.

The image carrier 44 includes a cylindrical drum 72 and a photoconductor layer 74 that is formed on the outer surface of the drum 72. The rotational period of the image carrier 44 is set to about 570 ms, for example. The drum 72 includes a conductive member made of aluminium or the like and is grounded. The photoconductor layer 74 is configured by an inorganic or organic photoconductor, and is charged by an electric charge supplied from the charging roll 56.

Further, an eliminator lamp 76 that neutralizes electric charge remaining on the photoconductor layer 74 after the image carrier 44 has transferred the toner image is disposed in the vicinity of the image carrier 44. The neutralizing lamp 76 is configured to neutralize one time the electric charge remaining on the photoconductor layer 74 each time the image carrier 44 completes one rotation, for example. Further, as mentioned above, the eliminator lamp 76 is switched OFF during the period of time when, for example, a later-described charging current detector 84 is detecting the current in accordance with the setting of the user.

The charging roll 56 charges the image carrier 44 by currents supplied from a direct current power supply 78 and an alternating current power supply 80. In other words, the charging roll 56 is configured to charge the image carrier 44 by a current in which an alternating component and a direct component are superposed.

An alternating current detector 82 that measures the current that the alternating current power supply 80 outputs is disposed between the alternating current power supply 80 and a ground.

The charging current detector 84 includes, for example, an 8-bit resolution A/D converter (not shown) that samples the current and A/D-converts the current and a low pass filter (not shown), samples and detects, after removing the alternating current component via the low pass filter, the current (charging current) in which the alternating component and the direct component supplied from the direct current power supply 78 and the alternating current power supply 80 are superposed, and outputs the charging current to a saturation determining unit 86, a leak current detector 88, and a charge amount detector 92.

Figure 3:
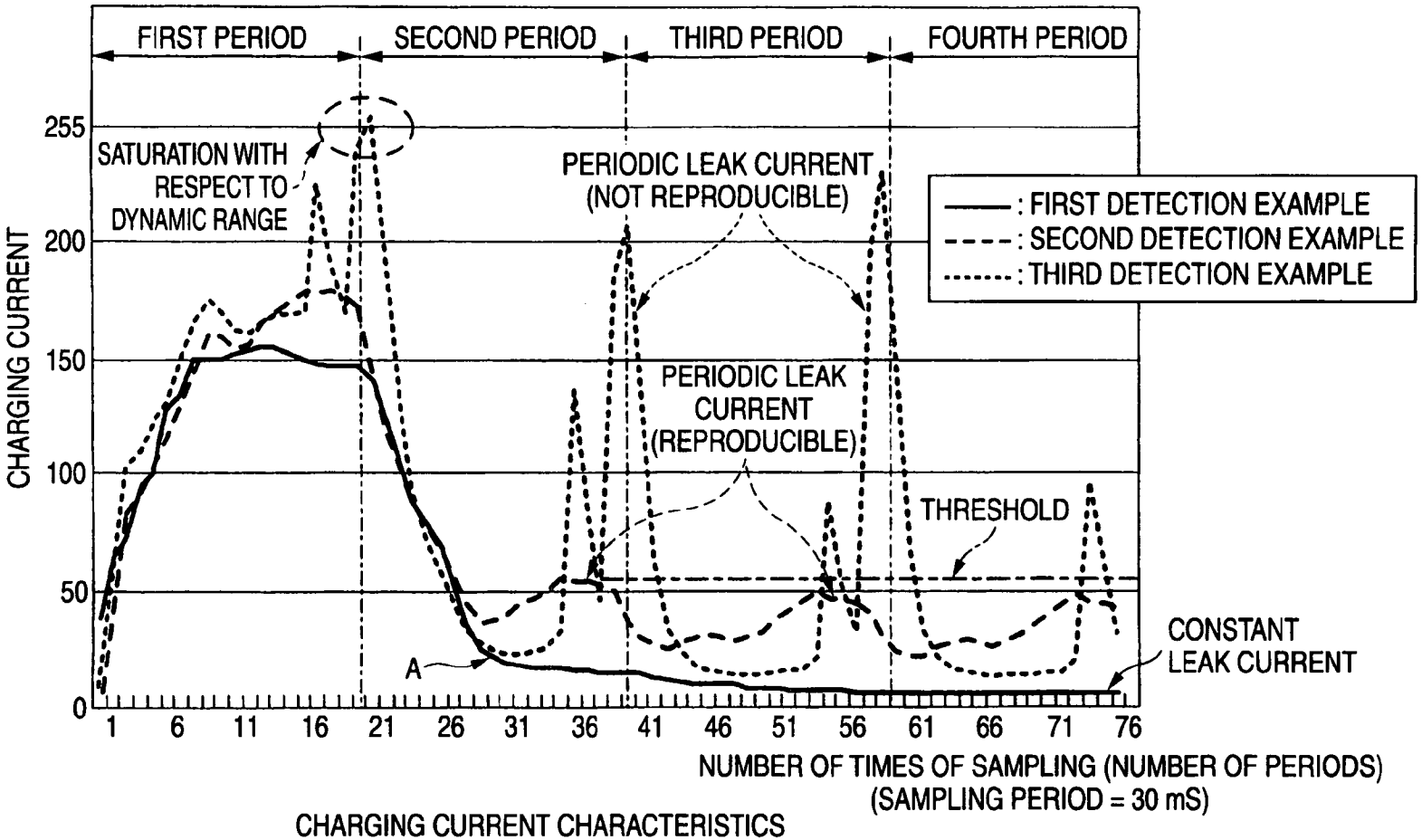
FIG. 3 is a graph showing three charging current characteristics that a charging current detector has sampled and detected in a state where an eliminator lamp has been switched OFF.

FIG. 3 is a graph showing three charging current characteristics that the charging current detector 84 has sampled and detected in a state where the eliminator lamp 76 has been switched OFF.

The charging current detector 84 is set such that the dynamic range of the A/D converter that detects the charging current can detect the combined value of the maximum value of a later-described reproducible periodic leak current and the current supplied to the image carrier 44. In the third detection example shown in FIG. 3, a local leak current that is not reproducible is saturated with respect to the dynamic range of the A/D converter.

It will be noted that the charging current detector 84 may also output the voltage value or the like corresponding to the charging current.

The saturation determining unit 86 analyzes the charging current inputted from the charging current detector 84 in accordance with the control by the controller 71, determines whether or not the charge amount of the photoconductor layer 74 of the image carrier 44 is saturated, and outputs the saturation period to a saturation time leak determining unit 90 as the determination result.

For example, as shown in FIG. 3, in the first detection example, the saturation determining unit 86 analyzes the fact that the charging current inputted from the charging current detector 84 has become a constant leak current amount in the fourth period of the image carrier 44 and determines that the charge amount of the photoconductor layer 74 of the image carrier 44 has become saturated in the fourth period. It will be noted that, as mentioned above, the rotational period of the image carrier 44 is set to about 570 ms, for example.

Further, the saturation determining unit 86 may also be set to determine the middle of the second period of the image carrier 44 to be the saturation period of the charge amount in accordance with the control by the controller 71, because the charge amount of the photoconductor layer 74 of the image carrier 44 reaches about 90% of a saturated state in the middle of the second period (point A in FIG. 3).

The leak current detector 88 analyzes the charging current inputted from the charging current detector 84 in accordance with the control by the controller 71, detects the constant leak current included in the charging current, the periodic (local) leak current that is reproducible, and the periodic (local) leak current that is not reproducible, and outputs these to the saturation time leak determining unit 90. The periodic leak current that is not reproducible flows when, for example, a pinhole forms in the image carrier 44.

For example, as shown in FIG. 3, in the first detection example, the leak current detector 88 detects that the charging current inputted from the charging current detector 84 has become a constant leak current amount in the fourth period of the image carrier 44. Further, in the second detection example, the leak current detector 88 detects that the charging current inputted from the charging current detector 84 has become a reproducible periodic leak current in the latter half of each rotational period of the image carrier 44. Further, in the third detection example, the leak current detector 88 detects that the charging current inputted from the charging current detector 84 has become a periodic leak current that is not reproducible from the latter half of each rotational period of the image carrier 44 to the former half of each next rotational period.

The saturation time leak determining unit 90 receives the determination result of the saturation determining unit 86 and the detection result of the leak current detector 88, compares the leak current after the charging amount of the image carrier 44 has become saturated (after the saturation period) with a predetermined threshold, and controls the charge amount detector 92 in accordance with the comparison result. For example, when the leak current is equal to or greater than the threshold, the saturation time leak determining unit 90 determines that a later-described layer thickness calculating unit 94 should not calculate the layer thickness of the photoconductor layer 74, and controls the charge amount detector 92 such that the charge amount detector 92 destroys the data representing the charging current received from the charging current detector 84. Further, when the leak current is less than the threshold, the saturation time leak determining unit 90 determines that the later-described layer thickness calculating unit 94 should calculate the layer thickness of the photoconductor layer 74, and controls the charge amount detector 92 such that the charge amount detector 92 integrates the charging current received from the charging current detector 84 to calculate the charge amount.

In other words, the saturation time leak determining unit 90 determines whether or not it is necessary for the layer thickness calculating unit 94 to calculate the layer thickness of the photoconductor layer 74.

Here, the saturation time leak determining unit 90 sets the threshold to be compared with the leak current to be equal to or less than the value of the reproducible periodic leak current that the leak current detector 88 has first detected, for example.

Further, the saturation time leak determining unit 90 may also be configured to set the threshold to be compared with the leak current in accordance with the time when a periodic leak current flows or the integrated value of the leak current.

Further, the saturation time leak determining unit 90 may also be configured to determine whether or not it is necessary for the layer thickness calculating unit 94 to calculate the layer thickness of the photoconductor layer 74 using the current that the charging current detector 84 has detected in a period of time equal to or greater than any one period of the image carrier 44, whose rotational period is relatively long, or the charging roll 56.

The charge amount detector 92 integrates the charging current received from the charging current detector 84 in accordance with the control by the saturation time leak determining unit 90, calculates the charge amount (e.g., current integrated value:ΣI=accumulated charge amount), and outputs this to the layer thickness calculating unit 94. However, the charge amount detector 92 is configured to not output anything to the layer thickness calculating unit 94 when the charge amount detector 92 is controlled by the saturation time leak determining unit 90, such as when the charge amount detector 92 is to destroy the data representing the charging current received from the charging current detector 84.

Figure 4:
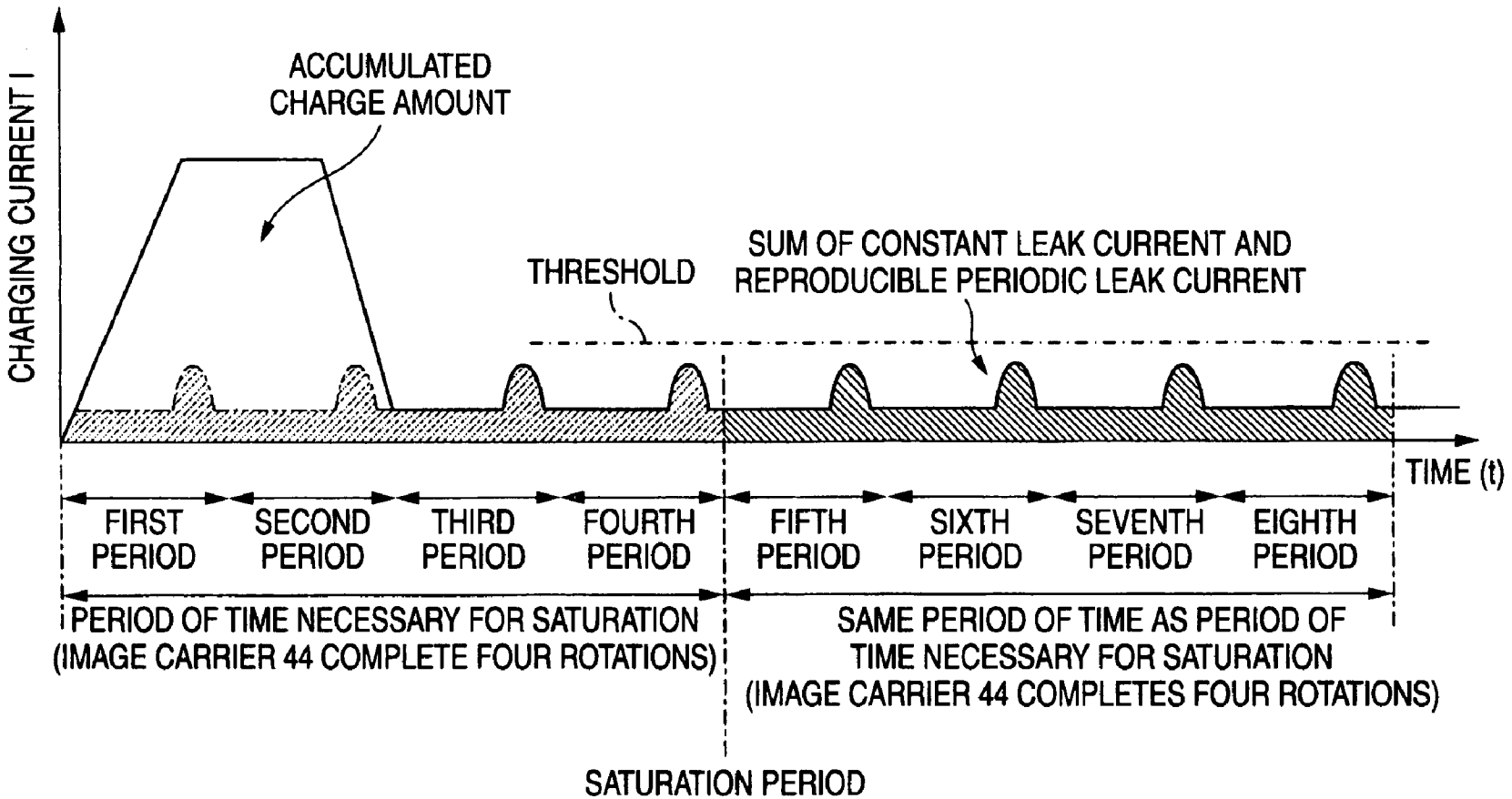
FIG. 4 is a graph showing a leak current that is used in order for a charge amount detector to calculate an accumulated charge amount.

Further, as shown in FIG. 4, the charge amount detector 92 may also be configured to calculate the accumulated charge amount of the photoconductor layer 74 of the image carrier 44 by subtracting, from the charging current that the charging current detector 84 has detected until the saturation determining unit 86 determines that the charging amount of the image carrier 44 is saturated, the constant leak current that the charging current detector 84 has detected in a period of time of the same length as the period of time in which the charging current was detected until the image carrier 44 reached the saturation period after the saturation determining unit 86 has determined that the charging amount of the image carrier 44 is saturated.

Even if a reproducible periodic leak current is included in the charging current while the image carrier 44 completes four rotations, when the sum of the constant leak current and the reproducible periodic leak current is less than the predetermined threshold, the charge amount detector 92 may also be configured to precisely calculate the accumulated charge amount of the photoconductor layer 74 of the image carrier 44 by subtracting the integrated value of the charging current of the fifth to eighth periods of the image carrier 44 from the integrated value of the charging current of the first to fourth periods of the image carrier 44, for example.

Further, the charge amount detector 92 may also be configured to subtract a value quadruple the charging current of the fifth period of the image carrier 44 from the integrated value of the charging current of the first to fourth periods of the image carrier 44, for example.

The layer thickness calculating unit 94 receives the integration result that the charge amount detector 92 outputs, calculates the layer thickness d of the photoconductor layer 74 by the following expression 1, and outputs the calculation result to the UI device 70 and the like.

$$d=\epsilon\cdot\epsilon O\cdot l\cdot D\cdot\pi\cdot V/\Sigma I \quad (1)$$

ϵ: permittivity of photoconductor layer 74

ϵO: permittivity of vacuum l: charging effective length of image carrier 44

D: diameter of photoconductor layer 74 (≅outer diameter of drum 72)

V: applied voltage of power supply 78

ΣI: current integrated value (accumulated charge amount)

Because the layer thickness d of the photoconductor layer 74 corresponds to a state (lifespan) that can determine the image quality of the image carrier 44, the user can determine the lifespan of the image carrier 44 via the UI device 70. Further, the UI device 70 may also output information indicating that the charging current detector 84 has detected an abnormal current or that at least either the image carrier 44 or the charging roll 56 has reached the end of its lifespan.

Next, processing where the image forming apparatus 10 calculates the thickness of the photoconductor layer 74 will be described.

Figure 5:
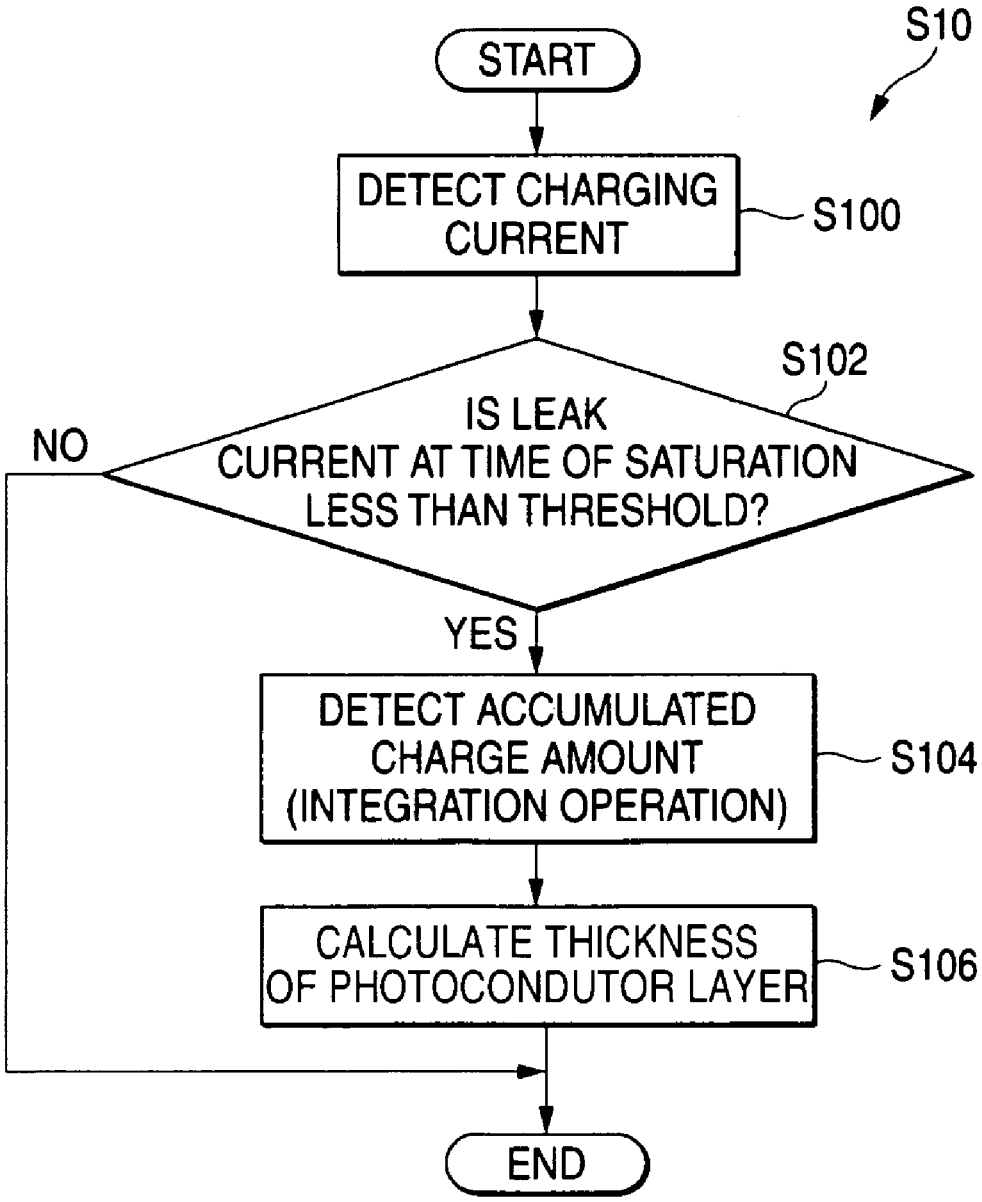
FIG. 5 is a flowchart showing processing (S10) where the image forming apparatus calculates the thickness of a photoconductor layer.

FIG. 5 is a flowchart showing processing (S10) where the image forming apparatus 10 calculates the thickness of the photoconductor layer 74.

As shown in FIG. 5, in step 100 (S100), the charging current detector 84 detects the charging current that the direct current power supply 78 (and alternating current power supply 80) outputs.

In step 102 (S102), the saturation time leak determining unit 90 determines whether or not the leak current at the time of saturation is less than the predetermined threshold. When the leak current is less than the threshold, the flow moves to the processing of S104, and when the leak current is equal to or greater than the threshold, the processing ends.

In step 104 (S104), the charge amount detector 92 detects (calculates) the accumulated charge amount of the photoconductor layer 74 of the image carrier 44.

In step 106 (S106), the layer thickness calculating unit 94 calculates the thickness (layer thickness d) of the photoconductor layer 74.

In this manner, in the image forming apparatus 10, the saturation time leak determining unit 90 compares the leak current at the time of saturation with the predetermined threshold, and when the leak current is equal to or greater than the threshold, the layer thickness is not calculated, so the layer thickness of the photoconductor layer 74 that the layer thickness calculating unit 94 has calculated is not affected by a periodic leak current that is not reproducible, and the precision becomes better.

Further, when the charging current detector 84 detects a periodic leak current that is reproducible, as in the second detection example shown in FIG. 3, the image forming apparatus 10 calculates the photoconductor layer 74 and determines the lifespan of the image carrier 44, and when the charging current detector 84 detects a periodic leak current that is not reproducible, as in the third detection example, the image forming apparatus 10 does not calculate the photoconductor layer 74, and can determine charging current abnormality or the lifespan of the image carrier 44, so that it can prevent excess abnormal determination, calculate the numerical value relating to the thickness of the photoconductor layer, and precisely determine the lifespan of the image carrier.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that rotates and carries a toner image by a surface layer disposed on a surface thereof;

a charging roll that charges the surface layer of the image carrier while the image carrier completes one or more rotations;

a power supply unit that supplies a current to the charging roll;

a detector that detects the current that the power supply unit outputs;

a leak current detector that detects a leak current included in the current that the detector has detected;

a layer thickness calculating unit that calculates a numerical value relating to the thickness of the surface layer of the image carrier on the basis of the current that the detector has detected; and a current leak state determining unit that determines a current leak state on the basis of the current that the detector has detected and the leak current that the leak current detector has detected, wherein the layer thickness calculating unit determines whether or not it should calculate the numerical value relating to the thickness of the surface layer in accordance with the determination result of the current leak state determining unit.

2. The image forming apparatus of claim 1, wherein the current leak state determining unit determines the current leak state by comparing a predetermined threshold with the leak current that the leak current detector has detected.

3. The image forming apparatus of claim 2, wherein the current leak state determining unit sets the threshold to be equal to or less than the periodic leak current that the leak current detector has first detected when the leak current that the leak current detector has detected is a periodic leak current that is reproducible.

4. The image forming apparatus of claim 1, wherein the charging roll rotates and charges the surface layer of the image carrier, and the current leak state determining unit determines the current leak state on the basis of the current that the detector has detected in a period of time equal to or greater than any one period of the charging roll or the image carrier whose rotational period is relatively long.

5. The image forming apparatus of claim 2, wherein the current leak state determining unit sets the threshold in accordance with the amount of time during which the leak current flows.

6. The image forming apparatus of claim 2, wherein the detector can detect a combined value of a maximum value of a periodic leak current that is reproducible and a current supplied to the image carrier.

7. The image forming apparatus of claim 2, wherein the current leak state determining unit sets the threshold in accordance with an integrated value of the leak current.

8. The image forming apparatus of claim 2, further comprising a counter that counts the number of rotations of the image carrier, wherein the current leak state determining unit determines the current leak state on the basis of the counting result of the counter.

9. The image forming apparatus of claim 2, further comprising a saturation determining unit that determines whether or not the charge amount of the surface layer is saturated, wherein the current leak state determining unit determines the current leak state on the basis of the determination result of the saturation determining unit.

10. The image forming apparatus of claim 9, wherein the current leak state determining unit determines the current leak state on the basis of the leak current after the charge amount of the surface layer has become saturated.

11. The image forming apparatus of claim 9, wherein the current leak state determining unit determines the current leak state on the basis of the leak current after the charge amount of the surface layer has exceeded 90% of a saturated state.

12. The image forming apparatus of claim 9, wherein when the current leak state determining unit has determined that the layer thickness calculating unit should calculate the numerical value, the layer thickness calculating unit calculates the numerical value relating to the thickness of the surface layer on the basis of the current that the detector has detected until the saturation determining unit determines that the charge amount of the surface layer is saturated, and the leak current that the leak current detector has detected in a period of time of the same length as the period of time when the detector has detected the current after the saturation determining unit has determined that the charge amount of the surface layer is saturated.

13. The image forming apparatus of claim 1, further comprising an information output unit which, when the current leak state determining unit has determined that the layer thickness calculating unit should not calculate the numerical value, outputs information indicating that the detector has detected an abnormal value or that at least any of the image carrier or the charging roll has reached the end of its lifespan.

14. An image forming apparatus comprising:

rotatable image carrying means for carrying a toner image by a surface layer disposed on a surface thereof;

charging means for charging the surface layer of the image carrying means while the image carrying means completes one or more rotations;

a power supply that supplies a current to the charging means;

detecting means for detecting the current that the power supply outputs;

leak current detecting means for detecting a leak current included in the current that the detecting means has detected;

layer thickness calculating means for calculating a numerical value relating to the thickness of the surface layer of the image carrying means on the basis of the current that the detecting means has detected; and current leak state determining means for determining a current leak state on the basis of the current that the detecting means has detected and the leak current that the leak current detecting means has detected, wherein the layer thickness calculating unit determines whether or not it should calculate the numerical value relating to the thickness of the surface layer in accordance with the determination result of the current leak state determining unit.

15. A layer thickness calculating method comprising:

while an image carrier that rotates and carries a toner image by a surface layer disposed on its surface completes one or more rotations, charging the surface layer while detecting a current that is supplied in order to charge the surface layer;

detecting a leak current included in the detected current;

determining a current leak state on the basis of the detected current and the leak current; and calculating a numerical value relating to the thickness of the surface layer in accordance with the determined current leak state, wherein the layer thickness calculating unit determines whether or not it should calculate the numerical value relating to the thickness of the surface layer in accordance with the determination result of the current leak state determining unit.

* * * * *